United States Patent [19]

Miller et al.

[11] Patent Number: 4,668,161

[45] Date of Patent: May 26, 1987

[54] VENTILATION OF TURBINE COMPONENTS

[75] Inventors: Edward H. Miller, Rexford; Kenneth E. Robbins, Burnt Hills, both of N.Y.

[73] Assignee: General Electric Company, Schenectady, N.Y.

[21] Appl. No.: 739,958

[22] Filed: May 31, 1985

[51] Int. Cl.[4] ..... F01D 5/06; F01D 5/08

[52] U.S. Cl. ..... 415/112; 415/115; 415/169 R; 415/176; 416/93 R; 416/174

[58] Field of Search ..... 415/110–113, 415/115–117, 175, 176, 180, 168, 169 R, 169 A, 121 A, 199.5, 170 R–174; 416/93 R, 95–97, 174

[56] References Cited

U.S. PATENT DOCUMENTS

| | | | |
|---|---|---|---|
| 1,931,724 | 10/1933 | Fageol et al. | 415/111 |
| 2,658,147 | 10/1953 | Brownhill et al. | 416/97 R |
| 2,988,325 | 6/1961 | Dawson | 415/115 |
| 3,230,710 | 1/1966 | Van Nimwegen et al. | 415/172 A |
| 3,392,910 | 7/1968 | Tanzberger | 415/111 |
| 3,647,311 | 3/1972 | Wootton et al. | 415/113 |
| 4,037,985 | 7/1977 | Karassik et al. | 415/175 |
| 4,425,077 | 1/1984 | Martin | 415/115 |
| 4,465,429 | 8/1984 | Martin et al. | 415/116 |
| 4,545,725 | 10/1985 | Ikeda et al. | 415/176 |

FOREIGN PATENT DOCUMENTS

| | | | |
|---|---|---|---|
| 2740155 | 3/1978 | Fed. Rep. of Germany | 415/111 |
| 70204 | 11/1977 | Japan | 415/115 |
| 14207 | 8/1978 | Japan | 415/168 |
| 74307 | 4/1984 | Japan | 415/172 A |
| 150907 | 8/1984 | Japan | 415/175 |
| 761435 | 11/1956 | United Kingdom | 415/115 |
| 868806 | 5/1961 | United Kingdom | 416/95 |

*Primary Examiner*—Robert E. Garrett
*Assistant Examiner*—Joseph M. Pitko
*Attorney, Agent, or Firm*—Jerome C. Squillaro

[57] ABSTRACT

Ventilation apparatus for creating a fluid flow through the interhub spacing between the hubs of adjacent turbine wheels which are not integral with the rotor of the turbine includes an outward radial extension of the hub of the downstream wheel and/or a roundoff of the hub of the upstream wheel and/or a displacement of the axis of the hub of the upstream wheel from the axis of the hub of the downstream wheel for increasing the static pressure over a first predetermined arcuate portion of the interhub spacing in an ancillary fluid flow between the hubs and a seal circumferentially surrounding the hubs. Also, either alone or in combination with the static pressure increasing devices, static pressure reduction apparatus includes an outward radial extension of the hub of the upstream wheel and/or a roundoff of the hub of the downstream wheel and/or a displacement of the axis of the hub of the upstream wheel from the axis of the hub of the downstream wheel for decreasing the static pressure over a second predetermined arcuate portion of the interhub spacing in the ancillary flow. Preferably, the first predetermined arcuate portion is disposed diametrically opposite to the second predetermined arcuate portion.

34 Claims, 4 Drawing Figures

VENTILATION OF TURBINE COMPONENTS

BACKGROUND OF INVENTION

This invention relates to ventilation of turbine components and, more particularly, is generally applicable to ventilation of inter-hub spacings of steam turbines having wheels that are not integral with the shaft of the turbine.

Some steam turbines utilize such large rotors that the turbine wheels, which carry turbine blades, or buckets, at their radially outer portions, are not an integral part of the shaft of the rotor. Each wheel of such turbines typically includes a hub section disposed generally at the radially inner portion of the wheel and each hub section includes a bore therethrough for receiving the shaft of the turbine.

To ensure proper and efficient operation of the turbine, it is required that turbine wheels be maintained at substantially fixed circumferential and axial locations relative to the shaft and relative to other wheels on the shaft. A wheel that is not an integral portion of the shaft may be secured to the shaft by a key and cooperating keyway disposed partially in the shaft and the wheel, and/or an interference shrink fit between the radially inner surface of the hub defining the wheel bore and a cooperating surface of the shaft. It has been suspected that stresses in the wheel hub due in part to shrink fits, in combination with other stresses generated by normal operation of the turbine, e.g. centrifugal stress and thermal stress, may create, in the pressure of a steam/water-/oxygen environment in the vicinity of the hub of the wheel, a situation which is conducive to fostering stress corrosion. The precise mechanism which produces stress corrosion is not fully understood. However, it is believed that if accumulation of water, such as may be obtained from condensed steam, along with the concentration of oxygen in steam and/or water which contacts the hub region of the wheel, especially in inter-hub spacings between wheels, is minimized, then the probability of stress corrosion occurring will be reduced, if not eliminated. Since it is critical that substantially all steam follow the designed main steam flow path through a turbine in order to obtain maximum efficiency, any attempt to alleviate the aforementioned problems should do so with minimum interference with the main steam flow path.

Accordingly, it is an object of the present invention to reduce and/or eliminate build-up of oxygen, or other non-condensible gas (such as carbon dioxide), concentration in the hub region of a turbine wheel wherein the wheel is not integral with the shaft of the turbine.

Still another object of the present invention is to provide a method and means for reducing the accumulation of water in the hub region of a turbine wheel, especially in inter-hub spacings between wheels, wherein the wheel is not integral with the shaft of the turbine.

It is another object of the present invention to provide a method and means for reducing the accumulation of water in the hub region of a turbine wheel, without affecting steam flow through the main steam flow path of the turbine, wherein the wheel is not integral with the shaft of the turbine.

SUMMARY OF THE INVENTION

In accordance with the present invention, wherein a steam turbine includes a rotor and at least a first and second wheel for respectively supporting a respective plurality of turbine blades, the first and second wheel being fixedly secured to and rotatable with the rotor, each of the first and second wheel including a generally radially inwardly disposed hub, the first and second wheel axially spaced from each other and including respectively opposing axial end walls to define an inter-hub spacing between the respective hub of the first and second wheel, ventilation means for urging steam flow through the interhub spacing comprises sealing means disposed in close proximity to and circumferentially surrounding at least a portion of the outer periphery of each hub and the included interhub spacing, the sealing means for defining an ancillary steam flow path between the sealing means and the at least a portion of the outer periphery of each hub, and pressure head recovery means in fluid flow communication with the interhub spacing for increasing the static pressure in the ancillary steam flow over a first predetermined arcuate portion of the periphery of the interhub spacing, whereby at least a portion of the ancillary steam flow is urged to flow into the interhub spacing. The static pressure in the ancillary flow may be increased, for example, by intercepting at least a portion of the ancillary flow and causing it to slow down, such as by rounding off the upstream hub and/or radially outwardly extending the downstream hub and/or displacing the axis of the hub of the first wheel from the axis of the hub of the second wheel. Likewise, the static pressure in the ancillary flow may be reduced either by itself or to compliment and assist the increase in static pressure for urging steam flow through the interhub spacing, such as by rounding off the downstream hub, and/or radially outwardly extending the upstream hub and/or displacing the axis of the hub of the first wheel from the axis of the hub of the second wheel.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

This invention relates to avoiding and/or eliminating environmental conditions that are believed to be favorable for promoting stress corrosion of components of a steam turbine. In general, as will be explained more fully below, the invention generates a continuous flow of steam in relatively enclosed regions of a steam turbine to establish a relatively uniform atmosphere and to discourage build up of products, such as water, e.g. from condensed vapor, and oxygen and carbon dioxide, which are believed to be conducive to initiating and supporting stress corrosion.

Figure 1:
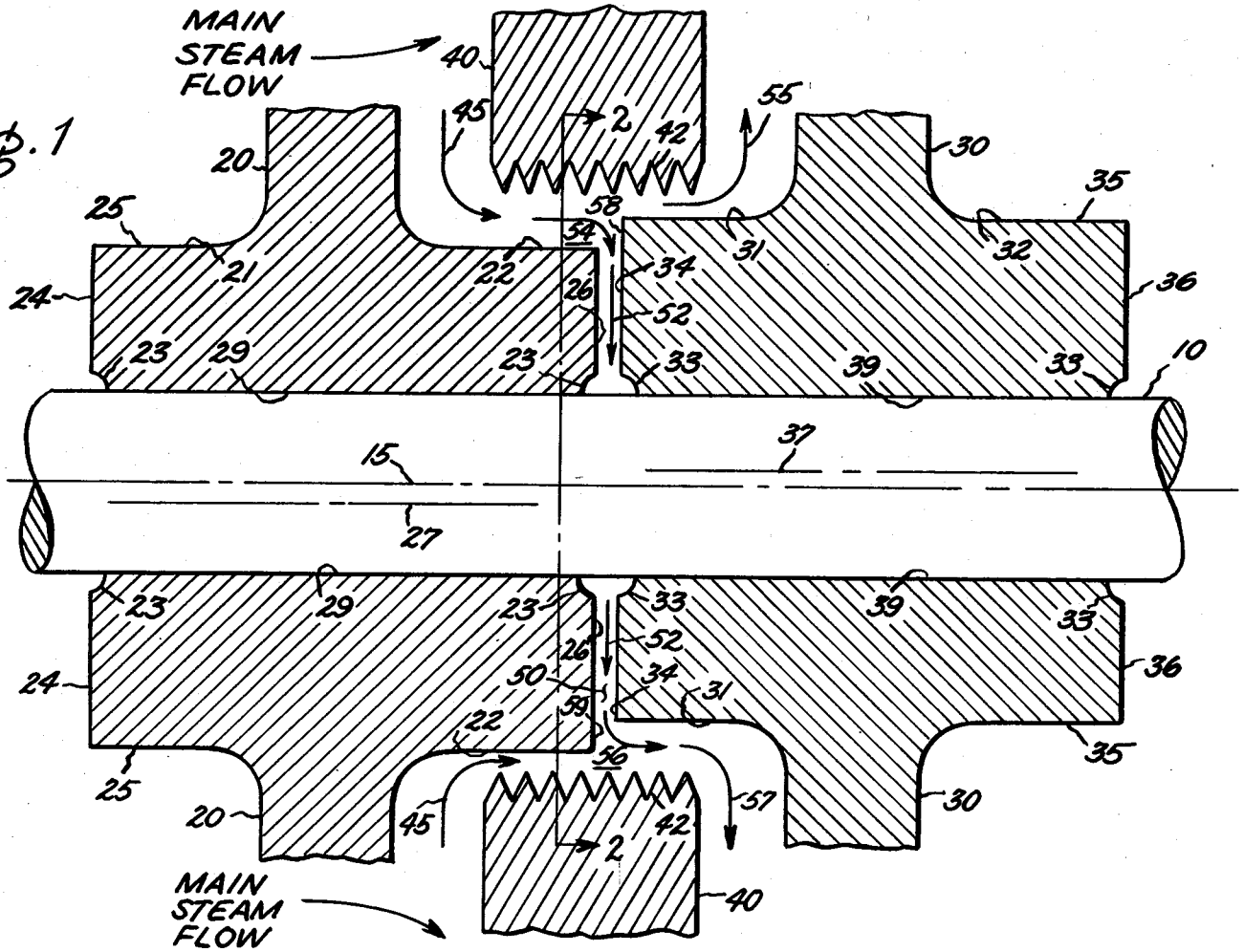
FIG. 1 is a partial elevation view in section of a steam in accordance with the present invention.

Referring to FIG. 1, a partial elevational view of a steam turbine in accordance with the present invention is shown. The steam turbine comprises a shaft 10 having an axis of rotation 15 and a pair of adjacent wheels 20 and 30 circumferentially surrounding shaft 10 and axially spaced from each other to form a gap region, or interhub spacing, 50 therebetween. Wheels 20 and 30 are shown as being not integral with shaft 10.

Wheel 20 comprises an axially extending hub portion 25 generally disposed at the radial inner portion of wheel 20 and at least one blade or bucket (not shown) disposed at the radially outer portion of wheel 20. Hub 25 includes an upstream (with respect to main steam flow direction) peripheral surface 21, a downstream peripheral surface 22, an upstream substantially radially extending (with respect to axis of rotation 15 of shaft 10) face 24 and a downstream substantially radially extending face 26. Peripheral surfaces 21 and 22 are typically cylindrical, having a central axis coextensive with axis 27 of hub 25.

Hub 25 further includes a radially inner surface 29 defining a bore therethrough. In order to prevent rotation of wheel 20 with respect to shaft 10 and/or wheel 30, surface 29 may be secured to the outer surface or periphery of shaft 10 by an interference shrink fit. In addition, a key and a corresponding keyway (not shown) may be disposed between hub 25 and shaft 10 to ensure that wheel 20 does not rotate with respect to shaft 10. Relief means 23, such as a circumferential cutout, may be provided at the intersection of surface 29 with faces 24 and 26.

Likewise, wheel 30 comprises an axially extending hub portion 35 generally disposed at the radial inner portion of wheel 30 and at least one blade or bucket (not shown) disposed at the radial outer portion of wheel 30. Hub 35 includes an upstream peripheral surface 31, a downstream peripheral surface 32, an upstream substantially radially extending face 34 spaced from face 26 of wheel 20 to define gap region 50 therebetween and a downstream substantially radially extending face 36. Peripheral surfaces 31 and 32 are typically cylindrical, having a central axis coextensive with axis 37 of hub 35. Hub 35 further includes a radially inner surface 39 defining a bore therethrough. In order to prevent rotation of wheel 30 with respect to shaft 10 and/or wheel 20, surface 39 may be secured to the outer surface or periphery of shaft 10 by an interference shrink fit. In addition, a key and a corresponding keyway (not shown) may be disposed between hub 35 and shaft 10 to ensure that wheel 30 remains irrotational with respect to shaft 10. Relief means 33, such as a circumferential cutout, may be provided at the intersection of surface 39 with faces 34 and 36.

A diaphragm or nozzle assembly 40, containing spaced apart nozzle partitions (not shown) for defining nozzles therebetween, is disposed between wheels 20 and 30 and includes a sealing means 42, such as labyrinth seal, which may be integral therewith, disposed at the radially inner portion thereof, for minimizing axial steam flow along periphery 22 of hub portion 25 of wheel 20 to periphery 31 of hub portion 35 of wheel 30. The spacing between seal 42 and periphery 22 and 31 of hubs 25 and 35 is shown enlarged in FIG. 1 for clarity. It is to be understood that this spacing is generally arranged to be as small as possible consistent with maintaining a seal between rotatable hubs 25 and 35 and stationary labyrinth seal 42. Typically the radial extent between hub 25 and 35 and seal 42 is about 0.03 inches.

The main steam flow path is generally along the radially outer portion of wheel 20 to intersect buckets (not shown) disposed thereon, then to pass between nozzle partitions (not shown) supported by diaphragm 40, and then to be directed into the downstream buckets (not shown) disposed on wheel 30 at the proper angle and velocity for obtaining maximum overall turbine efficiency. However, there is typically a secondary, ancillary or leakage or scavenging flow of steam 45 between labyrinth seal 42 and respective periphery 22 and 31 of hub 25 and 35, respectively, due to the operational pressure differential across seal 42. In accordance with the present invention, steam leakage flow 45 is used to generate and encourage a ventilating flow 52 of steam through gap region 50 without increasing the ancillary stream flow. The pressure drop across diaphragm 40 creates a relatively high velocity of leakage steam flow 45 past seal 42 and thus the pressure of flow past seal 42 is relatively low.

In one aspect, the present invention causes at least a portion of flow 45 to slow down or stagnate between seal 42 and hubs 25 and 35, resulting in a localized high pressure, or pressure head recovery, region 54, which in turn urges steam flow 52 into gap region 50. In another aspect, the present invention causes steam leakage flow 45 to aspirate gap region 50, creating a localized low pressure, or flow aspiration, region 56, thereby urging steam flow 52 to exit from gap region 50. Thus steam flow 52 enters gap region 50 from pressure head recovery region 54, is caused to diverge and divide as it approaches the periphery of rotor 10 (FIG. 2) and tends to converge and recombine on the opposite side of rotor 10 before exiting into aspiration region 56 from gap region 50. Although ventilation of gap region 50 is enhanced by creation of either localized high pressure region 54 or localized low pressure region 56 between seal 42 and gap region 50, it is preferable that localized high pressure region 54 and localized low pressure region 56 be simultaneously created and be substantially diametrically disposed in order to cooperate with and complement each other for increasing flow 52 through gap 50 over flow 52 obtainable using either localized high pressure region 54 or localized low pressure region 56 alone.

Figure 2:
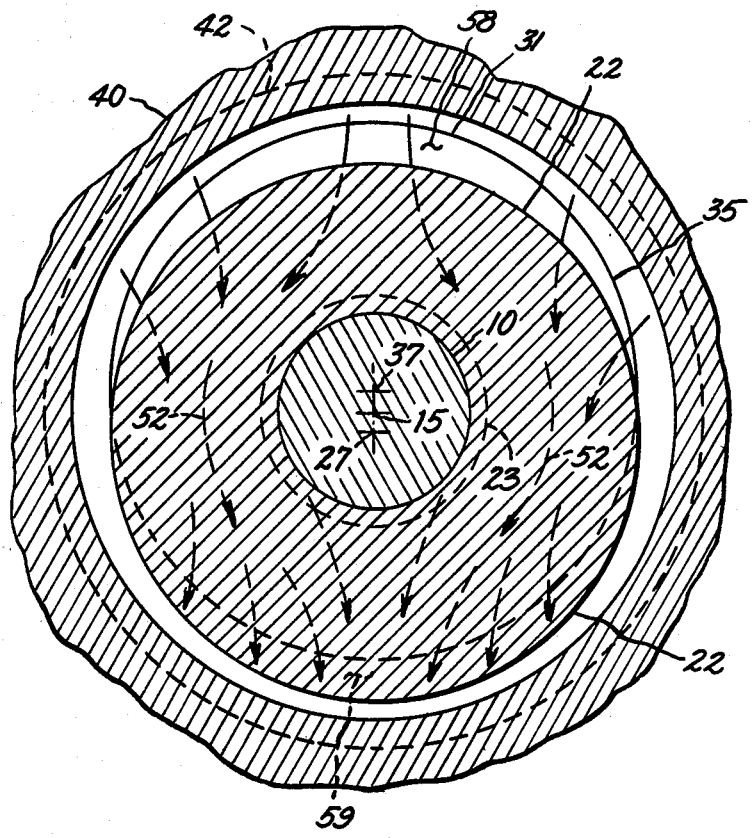
FIG. 2 is a view looking in the direction of the arrows of line 2—2 of FIG. 1.

As shown in FIGS. 1 and 2, in accordance with one aspect of the present invention, the axial center 27 of hub 25 is substantially parallel to, yet displaced from, or eccentric with respect to, axis of rotation 15 of rotor 10. Also, the axial center 37 of hub 35 is substantially parallel to, yet displaced from, or eccentric with respect to, axis of rotation 15 of rotor 10. Axial center 27 of hub 25 is also displaced from axial center 37 of hub 35. Hubs 25 and 35 are thus disposed with respect to each other such that over a first predetermined arcuate portion of periphery 31 of hub 35, periphery 31 of hub 35 radially extends further outward than a corresponding axially opposed first predetermined arcuate portion of periphery 22 of hub 25 radially outwardly extends. Thus a crescent shaped radial outward step, or flow stagnation surface, 58 (see FIG. 2) disposed adjacent to and downstream from pressure head recovery region 54 is created over the first predetermined arcuate portion of hub 35 at the intersection of periphery 31 and axial end face 34 of hub 35.

Hub 25 and 35 are also concurrently disposed with respect to each other such that over a second predetermined arcuate portion of periphery 22 of hub 25, periphery 22 of hub 25 radially extends further outward than a corresponding axially opposed second predetermined arcuate portion of periphery 31 of hub 35 radially outwardly extends. Thus a crescent shaped radial inward step 59 (see FIG. 2) disposed adjacent to and upstream from flow aspiration region 56 is created over the second predetermined arcuate portion of hub 25 at the intersection of periphery 22 and axial end face 26 of hub 25.

In operation, leakage steam 45, flowing between periphery 22 of hub 25 and seal 42, impinges upon step 58 which causes the velocity of at least a portion of steam flow 45 in pressure head recovery region 54 to decrease, thereby resulting in an increase in static pressure in pressure head recovery region 54 due to well-known principles of fluid mechanics, such as the conservation of energy and changes in momentum. Also, leakage steam 45 entering flow aspiration region 56 causes diffusion of flow proximate step 56 and gap 50, resulting in a decrease in static pressure in flow aspiration region 56 due to well-known principles of fluid mechanics.

Axis 15, 27 and 37 should lie in the same plane as shown in FIG. 2 for maximum effective pressure head recovery in region 54, i.e. circumferentially over 180° of hub 35, and cooperating maximum effective aspiration in region 56, i.e. circumferentially over 180° of hub 25 and disposed 180° from pressure head recovery region 54. As axes 27 and 37 approach each other while maintaining the same eccentricity, e.g. hub 25 is rotated with respect to hub 35, the predetermined arcuate stagnation pressure recovery step 58 and diametrically opposed corresponding aspiration step 59 become proportionately less than 180°. Displacing axis 27 and 37 a respective equal distance from axis 15 provides symmetry which aids in maintaining a balanced rotor configuration.

However, is not necessary for both axis 27 of hub 25 and axis 37 of hub 35 to be displaced from axis of rotation 15 of shaft 10. For example, if axis 37 of hub 35 is coextensive with axis of rotation 15 of shaft 10 and axis 27 of hub 25 is displaced with respect to axis of rotation 15 of shaft 10, step 58 and 59 will still be formed, resulting in formation of pressure recovery region 54 and aspiration region 56. However, to achieve the same fluid-dynamic effect as having both axis 27 and 37 displaced from axis 15, axis 27 of hub 25 would have to be displaced a distance from axis of rotation 15 of shaft 10 equal to the sum of the displacement of axis 27 and axis 37 from axis 15 as shown in FIG. 1. But, if only the axis of one of a pair of adjacent hubs, say axis 27 of hub 25, is displaced from axis 15 of shaft 10 and the axis of the other of the pair of adjacent hubs, say axis 37 of hub 35, is not displaced from axis of rotation 15 of shaft 10, then assembly of wheel 20 and 30 onto shaft 10 may be facilitated since alignment between axes 27 and 37 would not be necessary. It is important to note that the absolute positioning of pressure head recovery region 54 and aspiration region 56 with respect to a fixed non-rotating reference is not critical, since during operation, rotation of shaft 10 will cause pressure head recovery region 54 and aspiration region 56 to rotate and thus to be influenced by leakage flow 45 from the entire circumferential field of the main steam flow.

Figure 3:
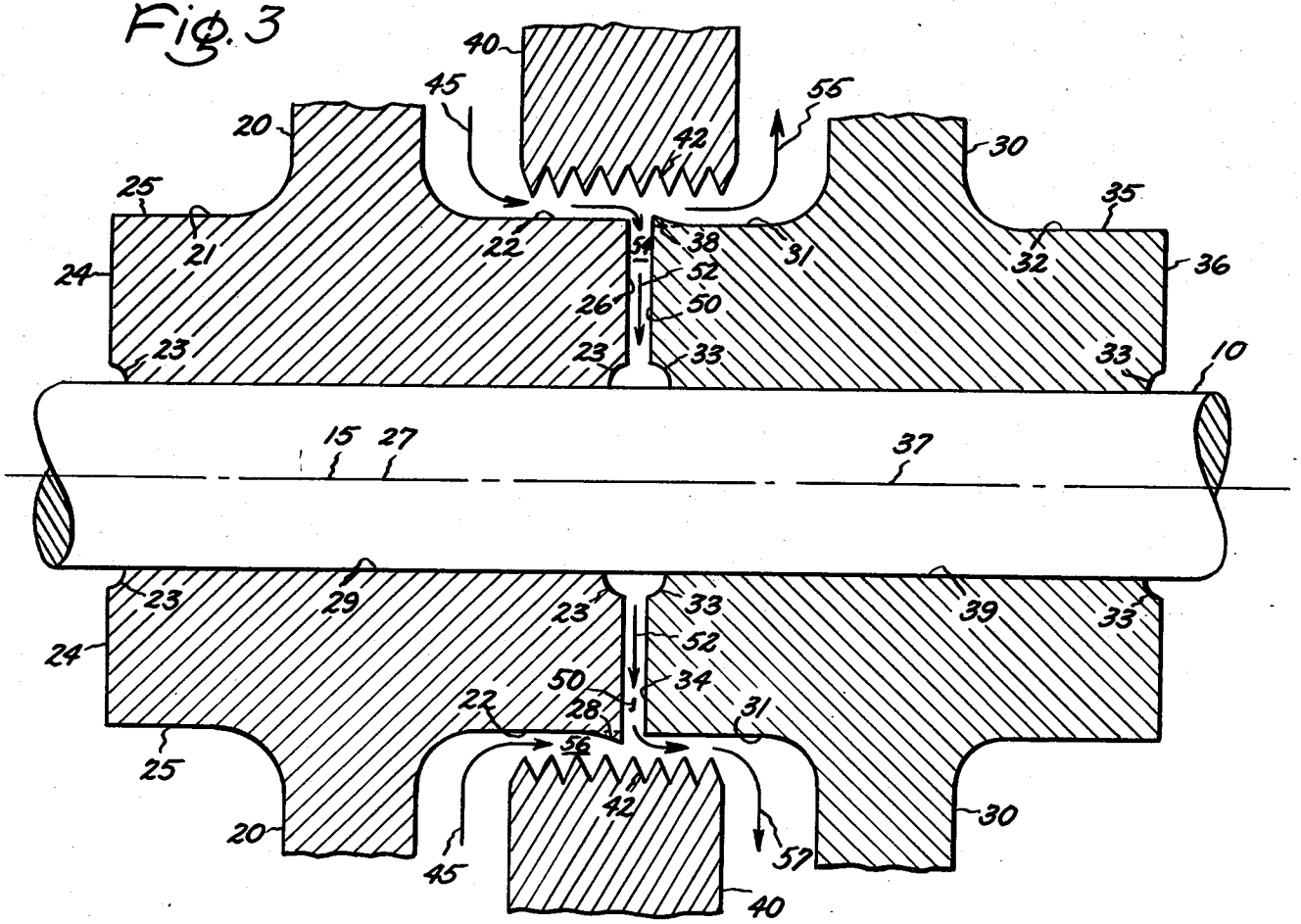
FIG. 3 is a partial elevational view of a steam turbine in accordance with another configuration of the present invention.

Referring to FIG. 3, another embodiment of the present invention is shown. Axis 27 of hub 25 and axis 37 of hub 35 are shown coextensive with axis 15 of rotor 10. A ledge or step 38 is attached to a predetermined arcuate portion of periphery 31 of wheel 35, such as by welding, at the intersection of periphery 31 and axial end face 34. A corresponding ledge or step 28 may be attached, such as by welding, to a predetermined arcuate portion of periphery 22 of hub 25 at the intersection of periphery 22 and axial end face 26. Preferably, step 28 is diametrically disposed from and has the same arcuate extent, up to a maximum of 180°, as does step 38. Of course step 28 and step 38 may be respectively fabricated as an integral part of hub 25 and 35, respectively.

Figure 4:
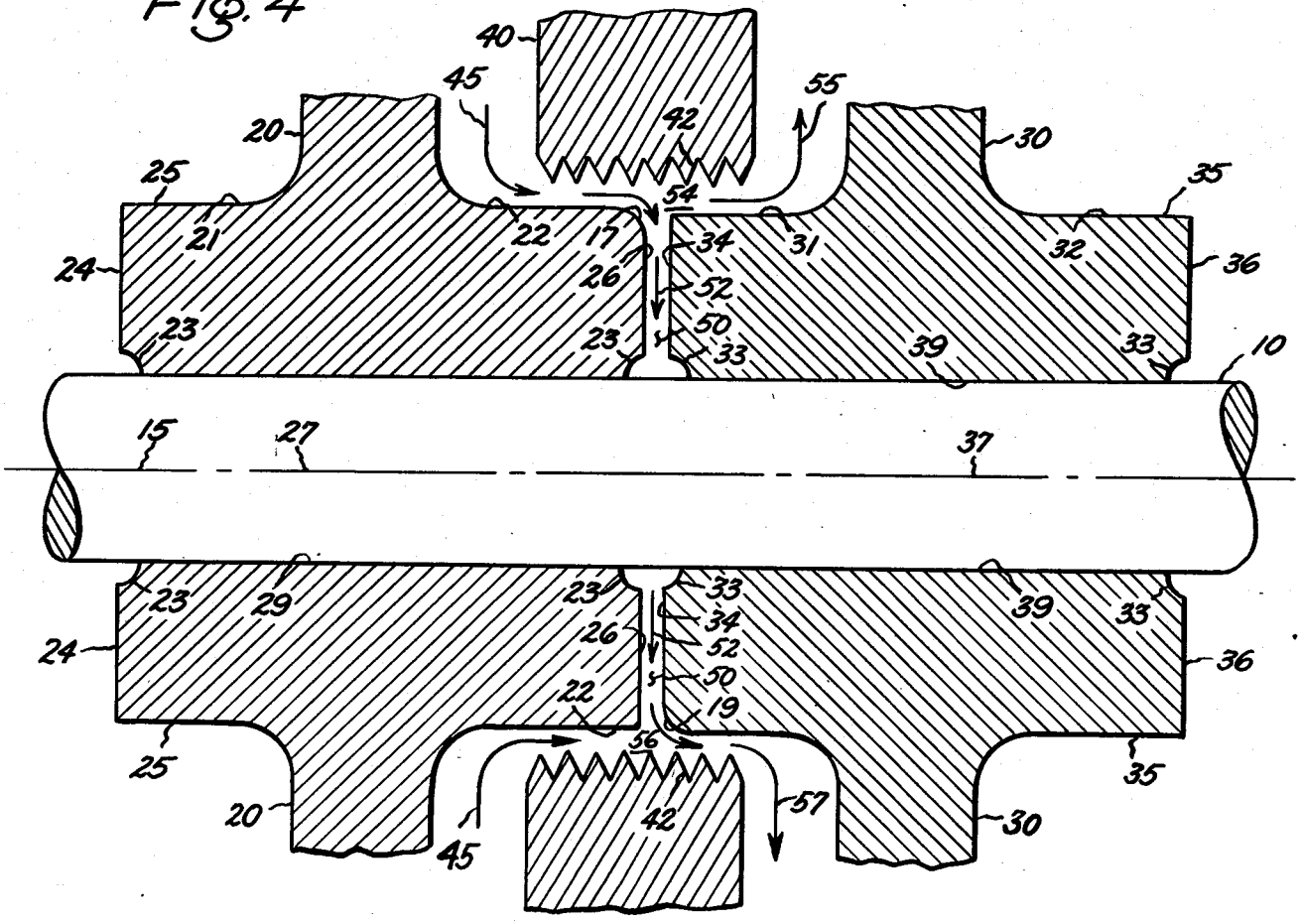
FIG. 4 is a partial elevational view of a steam turbine in accordance with still another configuration of the present invention.

Shown in FIG. 4 is another embodiment of the present invention. Axis 27 of hub 25 and axis 37 of hub 35 are shown coextensive with axis 15 of rotor 10. The intersection of axial end face 26 and periphery 22 of hub 25 is relieved, radially foreshortened or rounded-off, 17 over a predetermined arcuate portion of periphery 22, such that at least a portion of leakage steam 45 flowing between labyrinth seal 42 and periphery 22 will strike axial end face 34 of hub 35, thereby increasing the static pressure of steam in stagnation region 54 and inducing steam flow 52 through gap region 50. A corresponding relief or rounding-off 19 may be provided at the intersection of axial end face 34 and periphery 31 of hub 35, such that at least a portion of leakage steam 45 flowing between labyrinth seal 42 and periphery 22 will aspirate gap region 50, thereby urging steam flow 52 from inter-hub spacing 50 into aspiration region 56. Preferably, relief 19 is diametrically disposed from and has the same arcuate extent as relief 17. Alternatively, reliefs 17 and 19 may be chamfered at a predetermined angle.

Thus, by employing the teachings of the present invention, a desirable ancillary steam flow 52 may be established. Beneficial effects of steam flow 52 include: maintaining a constant temperature and relatively uniform environment in gap region 50; discouraging build-up of condensation and elminating or carrying off any condensation which may occur in gap region 50; eliminating sites for oxygen or other non-condensible gas concentration to occur in gap region 50; and further, pressure head recovery region 54 and aspiration region 56 rotate with hub 25 and 35, thus making ancillary flow 52 essentially independent of clearance changes between seal 42 and periphery 22 and 31, respectively, of hub 25 and 35 respectively. In addition, steam flow 52 exhibits a circumferential non-uniform flow pattern that rotates with hub 25 and 35. It is also to be understood that an appropriate combination of the above-described embodiments may be employed, such as using eccentric hubs along with rounding-off or build-up of the wheel hubs.

Thus has been illustrated and described a method and means for reducing the accumulation of water in the hub region of a turbine wheel, especially in the inter-hub spacings between wheels, without affecting steam flow through the main steam flow path of the turbine, when the wheel is not integral with the shaft of the turbine. Further, a method and means to reduce and/or eliminate oxygen or other non-condensible gas concentration in the hub region of a non-integral turbine wheel has been shown and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In a steam turbine including a rotor and at least a first and second wheel for respectively supporting a respective plurality of turbine blades, the first and second wheel respectively fixedly secured to and rotatable with the rotor, each of the first and second wheel including a generally radially inwardly disposed hub, the first and second wheel axially spaced from each other and including respectively opposing axial end walls to define an interhub spacing between the respective hub of the first and second wheel, ventilation means for urging steam flow through the interhub spacing, comprising:

sealing means disposed in close proximity to and circumferentially surrounding at least a portion of the outer periphery of each hub and the interhub spacing, said sealing means for defining an ancillary steam flow path between said sealing means and the at least a portion of the outer periphery of each hub; and pressure head recovery means in fluid flow communication with the interhub spacing for increasing the static pressure in the ancillary steam flow over a first predetermined arcuate portion of the periphery of the interhub spacing, whereby at least a portion of the ancillary steam flow is urged to flow into the interhub spacing.

2. Ventilation means as in claim 1, further comprising aspiration means in fluid flow communication with the interhub spacing for decreasing the static pressure in the ancillary steam flow over a second predetermined arcuate portion of the periphery of the interhub spacing.

3. Ventilation means as in claim 2, wherein at least a part of the first arcuate portion is diametrically opposed to at least a part of the second arcuate portion.

4. Ventilation means as in claim 3, wherein the first arcuate portion and the second arcuate portion each respectively include up to about 180° of the circumferential periphery of the interhub spacing.

5. Ventilation means as in claim 2 wherein the axis of the hub of the first and second wheel is respectively displaced from the axis of rotation of the rotor and further wherein the axis of the hub of the first wheel is displaced from the axis of the hub of the second wheel.

6. Ventilation means as in claim 2, wherein the periphery of the hub of the second wheel intersects the axial end wall of the second wheel and further wherein said aspiration means includes a radially foreshortened portion of the hub of the second wheel at the intersection of the periphery of the hub and the axial end wall of the second wheel.

7. Ventilation means as in claim 6, wherein the radially foreshortened portion includes rounding off the intersection of the periphery of the hub and the axial end wall of the second wheel.

8. Ventilation means as in claim 2, wherein the periphery of the hub of the first wheel intersects the axial end wall of the first wheel and further wherein said aspiration means includes a radial outward extension of the axial end wall of the first wheel at the intersection of the periphery of the hub of first wheel.

9. Ventilation means as in claim 8, wherein the extension is integral with the hub of the first wheel.

10. Ventilation means as in claim 1, wherein the periphery of the hub of the first wheel intersects the axial end wall of the first wheel and further wherein said pressure head recovery means includes a radially foreshortened portion of the hub of the first wheel at the intersection of the periphery of the hub and the axial end wall of the first wheel.

11. Ventilation means as in claim 10, wherein the radially foreshortened portion includes rounding off the intersection of the periphery of the hub and the axial end wall of the first wheel.

12. Ventilation means as in claim 1, wherein the periphery of the hub of the second wheel intersects the axial end wall of the second wheel and further wherein said pressure head recovery means includes a radial outward extension of the axial end wall of the second wheel at the intersection of the periphery of the hub of the second wheel.

13. Ventilation means as in claim 12, wherein the extension is integral with the hub of the second wheel.

14. In a steam turbine including a rotor and at least a first and second wheel for respectively supporting a respective plurality of turbine blades, the first and second wheel respectively fixedly secured to and rotatable with the rotor, each of the first and second wheel including a generally radially inwardly disposed hub, the first and second wheel axially spaced from each other and including respectively opposing axial end walls to define an interhub spacing between the respective hub of the first and second wheel, ventilation means for urging steam flow through the interhub spacing, comprising:

sealing means disposed in close proximity to and circumferentially surrounding at least a portion of the outer periphery of each hub and the interhub spacing, said sealing means for defining an ancillary steam flow path between said sealing means and the at least a portion of the outer periphery of each hub;

pressure head recovery means in fluid flow communication with the interhub spacing for increasing the static pressure in the ancillary steam flow over a first predetermined arcuate portion of the periphery of the interhub spacing, whereby at least a portion of the ancillary steam flow is urged to flow into the interhub spacing; and aspiration means in fluid flow communication with the interhub spacing for decreasing the static pressure in the ancillary steam flow over a second predetermined arcuate portion of the periphery of the interhub spacing;

wherein the axis of the hub of the first wheel is displaced from the axis of rotation of the rotor and further wherein the axis of the hub of the second wheel is coextensive with the axis of rotation of the rotor, whereby over a first predetermined arcuate portion, the hub of the first wheel radially outwardly extends further than an opposing second predetermined arcuate portion of the hub of the second wheel, and further whereby over a third predetermined arcuate portion of the hub of the second wheel, the hub of the second wheel radially outwardly extends further than an qpposing fourth predetermined arcuate portion of the hub of the first wheel.

15. In a steam turbine including a rotor and at least a first and second wheel for respectively supporting a respective plurality of turbine blades, the first and second wheel respectively fixedly secured to and rotatable with the rotor, each of the first and second wheel including a generally radially inwardly disposed hub, the first and second wheel axially spaced from each other and including respectively opposing axial end walls to define an interhub spacing between the respective hub of the first and second wheel, ventilation means for urging steam flow through the interhub spacing, comprising:

sealing means disposed in close proximity to and circumferentially surrounding at least a portion of the outer periphery of each hub and the interhub spacing, said sealing means for defining an ancillary steam flow path between said sealing means and the at least a portion of the outer periphery of each hub; and aspiration means in fluid flow communication with the interhub spacing for decreasing the static pressure in the ancillary steam flow over a first predetermined arcuate portion of the periphery of the interhub spacing, whereby at least a portion of the ancillary steam flow is urged to flow through the interhub spacing without increasing the ancillary steam flow.

16. Ventilation means as in claim 15, further comprising pressure head recovery means in fluid flow communication with the interhub spacing for increasing the static pressure in the ancillary steam flow over a second predetermined arcuate portion of the periphery of the interhub spacing.

17. Ventilation means as in claim 16, wherein at least a part of the first arcuate portion is diametrically opposed to at least a part of the second arcuate portion.

18. Ventilation means as in claim 16, wherein the first arcuate portion and the second arcuate portion each respectively include up to about 180° of the circumferential periphery of the interhub spacing.

19. Ventilation means as in claim 16, wherein the axis of the hub of the first wheel is displaced from the axis of rotation of the rotor and further wherein the axis of the hub of the second wheel is coextensive with the axis of rotation of the rotor, whereby over a first predetermined arcuate portion, the hub of the first wheel radially outwardly extends further than an opposing second predetermined arcuate portion of the hub of the second wheel, and over a third predetermined arcuate portion, the hub of the second wheel radially outwardly extends further than an opposing fourth predetermined arcuate portion of the hub of the first wheel.

20. Ventilation means as in claim 16, wherein the axis of the hub of the first and second wheel is respectively displaced from the axis of rotation of the rotor and further wherein the axis of the hub of the first wheel is displaced from the axis of the hub of the second wheel.

21. Ventilation means as in claim 16, wherein the periphery of the hub of the second wheel intersects the axial end wall of the second wheel and further wherein said pressure head recovery means includes a radially foreshortened portion of the hub of the first wheel at the intersection of the periphery of the hub and the axial end wall of the first wheel.

22. Ventilation means as in claim 21, wherein the radially foreshortened portion includes rounding off the intersection of the periphery of the hub and the axial end wall of the first wheel.

23. Ventilation means as in claim 16, wherein the periphery of the hub of the second wheel intersects the axial end wall of the second wheel and further wherein said pressure head recovery means includes a radial outward extension of the axial end wall of the second wheel at the intersection of the periphery of the hub of second wheel.

24. Ventilation means as in claim 23, wherein the extension is integral with the hub of the second wheel.

25. Ventilation means as in claim 15, wherein the periphery of the hub of the second wheel intersects the axial end wall of the second wheel and further wherein said aspiration means includes a radially foreshortened portion of the hub of the second wheel at the intersection of the periphery of the hub and the axial end wall of the second wheel.

26. Ventilation means as in claim 25, wherein the radially foreshortened portion includes rounding off the intersection of the periphery of the hub and the axial end wall of the second wheel.

27. Ventilation means as in claim 15, wherein the periphery of the hub of the first wheel intersects the axial end wall of the first wheel and further wherein said aspiration means includes a radial outward extension of the axial end wall of the first wheel at the intersection of the periphery of the hub of first wheel.

28. Ventilation means as in claim 27, wherein the extension is integral with the hub of the first wheel.

29. In a steam turbine having a main path for steam flow defined therethrough, the steam turbine including a rotor and at least a first and second wheel for respectively supporting a respective plurality of turbine blades, the first and second wheel respectively fixedly secured to and rotatable with the rotor, each of the first and second wheel including a generally radially inwardly disposed hub, the first and second wheel axially spaced from each other to form a interhub spacing between the respective hubs of the first and second wheel, a method for ventilating the interhub spacing, comprising:

forming an ancillary path for steam flow; and directing at least a portion of the steam flow from the ancillary path through the interhub spacing by forming a localized high pressure region over a first predetermined arcuate portion of the interhub spacing.

30. The method as in claim 29, wherein the step of directing further includes forming a localized low pressure region over a second predetermined arcuate portion of the interhub spacing.

31. The method as in claim 30, wherein at least a portion of said first predetermined arcuate portion is diametrically opposed to at least a portion of said second predetermined arcuate portion.

32. The method as in claim 29, wherein the step of forming an ancillary path for steam flow includes circumferentially surrounding at least a portion of the hub of the first and second wheel and the interhub spacing with a seal, said seal blocking substantially all steam flow from the periphery of the hub of the first wheel to the periphery of the hub of the second wheel, such that only a leakage flow exists in the ancillary path.

33. In a steam turbine having a main path for steam flow defined therethrough, the steam turbine including a rotor and at least a first and second wheel for respectively supporting a respective plurality of turbine blades, the first and second wheel respectively fixedly secured to and rotatable with the rotor, each of the first and second wheel including a generally radially inwardly disposed hub, the first and second wheel axially spaced from each other to form an interhub spacing between the respective hubs of the first and second wheel, a method forventilating the interhub spacing, comprising:

forming an ancillary path for steam flow; and directing at least a portion of the steam flow from the ancillary path through the interhub spacing by forming a localized high pressure region over a first predetermined arcuate portion of the interhub spacing;

wherein the hub of the first and second wheel respectively include a central axis and the step of directing further includes disposing at least the first wheel such that the axis of the hub of the first wheel is eccentric with respect to the axis of rotation of the rotor.

34. The method as in claim 33, wherein the step of directing further includes disposing the second wheel such that the axis of the hub of the second wheel is eccentric with respect to the axis of the hub of the first wheel and further is eccentric with respect to the axis of rotation of the rotor.

* * * * *